United States Patent [19]

Arraval

[11] Patent Number: 4,620,528

[45] Date of Patent: Nov. 4, 1986

[54] FINGER-OPERATED DENTAL CARE IMPLEMENT

[76] Inventor: Valentim Arraval, 817 Hampton Ct., Westbury, N.Y. 11590

[21] Appl. No.: 656,872

[22] Filed: Oct. 2, 1984

[30] Foreign Application Priority Data

Aug. 8, 1984 [BR] Brazil ..... 8404050

[51] Int. Cl.[4] ..... A61H 7/00

[52] U.S. Cl. ..... 128/62 A; 128/66; 15/167 R

[58] Field of Search ..... 128/62 A, 66; 15/167 R

[56] References Cited

U.S. PATENT DOCUMENTS

| | | | |
|---|---|---|---|
| 128,093 | 6/1872 | Allerton | 128/62 A |
| 619,466 | 2/1899 | Buchmann | 128/62 A |
| 757,907 | 4/1904 | Fritz | 128/62 A |
| 1,144,777 | 6/1915 | Over | 128/62 A |
| 1,168,998 | 1/1916 | Bradenburg | 128/62 A |
| 1,200,596 | 10/1916 | Daly | 128/62 A |
| 1,408,520 | 3/1922 | Larsen | 128/62 A |
| 2,016,951 | 10/1935 | Welker | 128/62 A |
| 2,077,540 | 4/1937 | Welker | 128/62 A |
| 2,968,827 | 1/1961 | Lawsine | 128/62 A |
| 3,043,295 | 7/1962 | Ward | 128/62 A |
| 3,623,481 | 11/1971 | Curran | 128/62 A |

FOREIGN PATENT DOCUMENTS

| | | | |
|---|---|---|---|
| 324237 | 1/1930 | United Kingdom | 128/62 A |

*Primary Examiner*—John J. Wilson

*Attorney, Agent, or Firm*—Darby & Darby

[57] ABSTRACT

A finger operated article for dental care including a flexible finger tube resembling the finger of a glove and being suitable for wear on a finger of the user. A dental care implement mounted at the fingertip, and a flexible tube attached to the implement for delivery of a fluid to the point of use. The irrigation tube being connected to a bulb reservoir for containing the fluid.

1 Claim, 6 Drawing Figures

FINGER-OPERATED DENTAL CARE IMPLEMENT

FIELD OF THE INVENTION

The present invention relates to an improved article for dental care, more particularly to a finger-operated dental care article, such as a toothbrush, a rubber tip for gum massaging, and the like. Use of the present invention promotes proper brushing and care of the teeth and gums and serves to reduce the incidence of enamel abrasion and/or gum injury that lead to cavities and periodontal disease.

BACKGROUND OF THE INVENTION

Conventional dental care implements, such as toothbrushes, are usually provided with a relatively hard, usually plastic or wood, handle. In the case of a toothbrush, the handle is flattened at one end where the brush bristles are inserted. The handle may be straight or slightly curved.

Ideally, a toothbrush should clean the tooth surfaces, thus preventing the formation of bacterial plaque thereon, and to massage the gingivae, thus increasing the blood circulation therein and preventing gingivitis which can lead to periodontal disease, gum recession, jaw bone reduction, tooth loosening and loss.

Unfortunately, human teeth are rather irregularly shaped and have many curves and hard to reach surfaces, including nooks and cranies. Likewise, the gums are also hard to massage and clean.

Brushing, when done with a conventional toothbrush is inadequate to protect against cavities. The ordinary toothbrush is incapable of reaching around gum and tooth corners and in the cranies on and between teeth, even when brusing is done by dutifully following a dentist's or dental hygienist's directions. Even toothbrushes that have a bent, or smaller-than-usual, brush end cannot adequately clean these hard-to-reach gum and tooth surfaces. Moreover, use of such specialized toothbrushes significantly increases the time an individual has to spend for cleaning his teeth and most people are reluctant to use them. Electric toothbrushes and water jets only serve to increase the number of paraphernalia necessary for tooth care. The result is that their beneficial effects are curtailed or even annulled by the fact that they are time consuming, cumbersome, and inefficient to use.

Worse, use of a conventional toothbrush can be outright harmful for the teeth and gums. The reason is that the inflexible handle is not sensitive to the amount of pressure applied on the teeth and gums, or to the nature and curvature of the surface being brushed. Zealous brushers tend to apply pressure on the toothbrush, which is transferred through the rigid toothbrush onto the teeth and gums. In fact, the handle behaves as a lever increasing the pressure applied to the tooth or gum. The user of the toothbrush is not conscious of the amount of pressure he is applying because of the reduced sensitivity of tooth and gum tissue (as compared to that of the skin, for example), and he does not have adequate control of the pressure exerted on the teeth and gums.

One or more of the following problems can be traced directly to harsh brushing:

(1) Injury to the gingivae. This leads to gingivitis, inflammation of the gingiva and/or the oral mucous membrane due to its invasion by bacteria made possible by a break in the gingiva caused by hard brushing or gum massaging with another implement for dental care. This also causes "periodontal disease", i.e. it leads to gum recession, which in turn causes bone shrinkage and formation of alveolar pockets. It eventually causes loosening and loss of teeth. It is often directly traceable to injury of the gums from too harsh brushing. Management of periodontal disease is very expensive and often involves surgical intervention.

(2) Cavities. Harsh brushing causes grooves to be formed on the tooth enamel, especially along the gum line where the impact of the pressure during brushing is most severely felt. The so-formed grooves provide a nesting ground and ready access to the dentyne for caries-causing bacteria.

OBJECTS OF THE INVENTION

It is an object of this invention to provide an improved toothbrush or other dental care implement that would enable the user to exert sufficient control over it to gently, yet thoroughly, clean teeth in spite of the rather irregular and intricate shape of the latter.

It is another object of this invention to provide an improved toothbrush or other dental care implement that enables the user to control the amount of pressure exerted on the teeth and gums and avoid injuring them.

It is yet another object of this invention to provide an improved toothbrush or other dental care implement that allows the user to massage the gums gently, yet thoroughly, so as to improve blood circulation therein.

It is a further object of this invention to provide a toothbrush or other dental care implement that can combine in one step brushing and antiseptizing or treating the teeth with a water jet, and the like, so as to reduce the time spent on dental care without compromising thoroughness or quality of dental care.

These and other objects of the invention will be apparent to one of ordinary skill in the art in light of the present description, appended claims and accompanying drawings.

SUMMARY OF THE INVENTION

A finger-operated article for dental care comprising:

a flexible tube having inner and outer surfaces and a closed end, said tube resembling the finger of a glove and being suitable for wear on the finger of the user;

a dental care implement mounted at the closed end of said tube at a position on the outer tube surface corresponding to the portion of the inner surface coming in contact with the user's fingertip.

The article of the present invention affords the user fingertip control of the dental care implement and allows him to direct it more precisely to the teeth and gums for thorough care and to control the pressure applied to said teeth and gums to gentle levels so as to avoid injury. The implement of the present invention may be equipped with an extension for holding in the palm of the hand, thereby maintaining the tube substantially fixed on the user's finger.

DETAILED DESCRIPTION OF THE INVENTION

Figure 2:
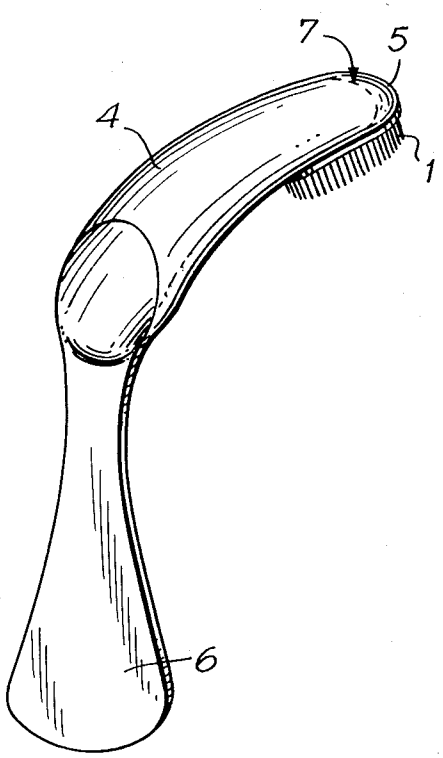
FIGS. 1 and 2 schematically show two opposite views of one embodiment of a toothbrush according to the present invention wherein a flexible tube in the shape of a glove finger is used for bearing the brush. The tube also is equipped with a handle for better control.
Figure 1:
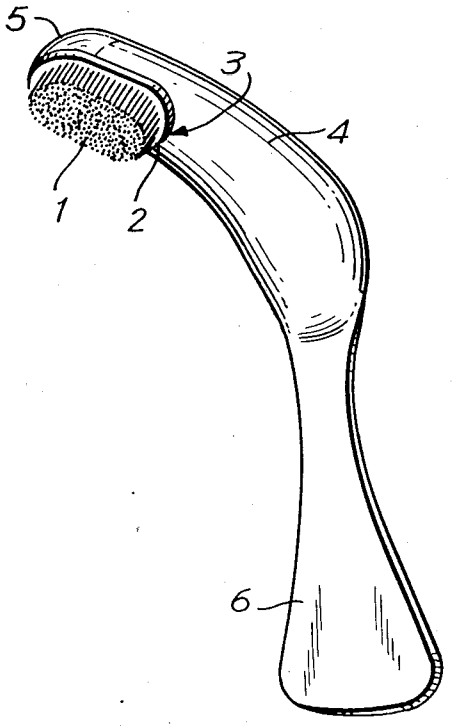

With particular reference to FIGS. 1–6, the present invention provides an improved finger-operated dental care article. FIGS. 1 and 2 illustrate an embodiment of the present invention wherein the implement is a brush, 1. The brush is mounted on a brush base, 2 in turn mounted on (or integral with) one side, 3, of the closed end, of tube 4. Tube 4 is in the general shape of a glove finger and is made of flexible (extensible) material such as plastic or preferably rubber. Location 3 corresponds to the position of the fingertip of the user, where the sense of touch (and, therefore, sensitivity) and motility (and, therefore, dexterity and control) are at a maximum.

Desirable properties for the tube material are that it be extensible so as to fit a range of finger sizes (the tube could, of course, come in different sizes, such as small, medium and large, as gloves do) It should also be flexible so as to allow substantially unencumbered flexing and turning of the user's finger. Finally, it should be sufficiently strong to withstand contact with tooth edges and human fingernails and to have a reasonably long useful life, and it should be non-toxic and acceptable for oral use.

Suitable tube materials include plastic and/or rubber polymers and copolymers, in particular resins of monomers such as ethylene, propylene, methyl or ethyl acrylate or methacrylate, vinyl acetate, acrylonitrile, acrylic and methacrylic acid, vinyl chloride, vinylidene chloride, styrene, butadiene, etc. Latexes and rubber are preferred. Mixtures or resins and rubbers can also be used. Finally, hydrophilic polymer-coated rubber tubes and laminates can also be used. Rubber latexes are preferred, such as those described in U.S. Pat. No. 4,082,862 of Esemplare et al. issued on Apr. 4, 1978, or U.S. Pat. No. 3,856,561 also of Esemplare issued on Dec. 24, 1974 or U.S. Pat. No. 4,304,008 to Young issued Dec. 8, 1981, or U.S. Pat. No. 3,813,695 to Podell issued June 4, 1974. The disclosure of these patents is incorporated herein by reference.

The tip 5 of tube 4 can be made of the same material and can, preferably, bear a reinforcement 7 to protect against premature wear caused by the user's fingernail. Base 2 can be made of any thin plastic, wood or other material strong enough to bear the bristles of a brush. Ordinary toothbrush materials, when thin enough, are preferred. Thinness is desirable to maintain a sense of touch trhough the brush material. Base 2 can be constructed to conform to the slight curvature of fingertips. The bristles of the brush are conventional plastic or natural bristles.

Tube 4 can be made by any well-known method for making rubber or plastic gloves. According to such methods, a former in the shape of a finger is provided, which is dipped into a latex (or polymer or prepolymer). The latex is then dried, stripped off the former and vulcanized. If a prepolymer or polymer is used, it is then accordingly polymerized to the desired molecular weight and/or crosslinked (e.g. by heating) to the desired degree of cross linking.

The article of the present invention can be preferably equipped with a handle, 6, fixed to glove finger 4 at its open end 7. Handle 6 can also be made of plastic but should preferably be not as flexible as the glove finger, so as to provide some support of the glove finger. Handle 6 should be preferably resilient, if necessary, so as not to encumber motility of the user's finger and not to provide the user with leverage (as ordinary toothbrushes do) which would increase the pressure on the finger. Except for support, handle 6 serves to enhance control of the implement by the user. Thus, the user can clutch on to handle 6 so as to prevent glove finger 4 (i.e. the flexible tube) from slipping against the user's finger during use. The shape of handle 6 is slightly curved so as to substantially conform to the curvature of the palm of the hand.

The handle, 6, can be fused or adhered onto the former by conventional, well-known methods.

Figure 4:
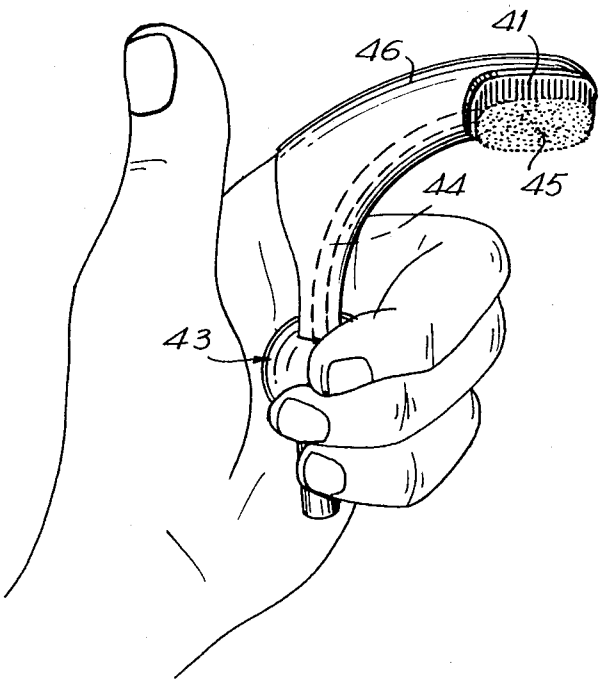
FIGS. 3 and 4 schematically show two opposite views of an alternative embodiment of a toothbrush according to the present invention (with FIG. 4 showing said embodiment worn on the index finger of the user) wherein the present toothbrush is equipped with an irrigation tube.
Figure 3:
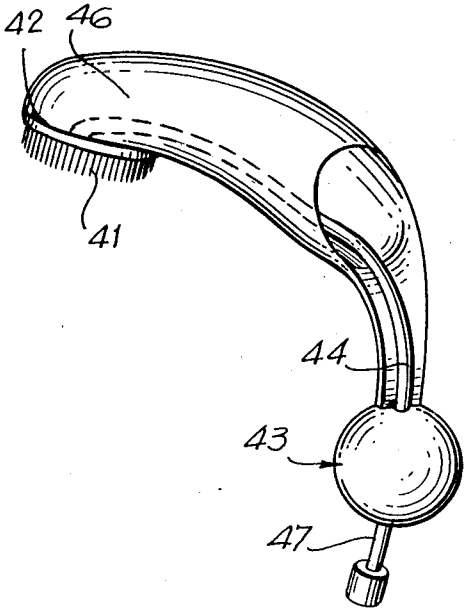

FIGS. 3 and 4 show a toothbrush according to the present invention wherein the toothbrush, 41 is equiped with irrigation tube 44. The brush base 42, has one or more openings 45 that can be used for delivery of a liquid to the teeth or gums through the irrigation tube. Handle 43 can be used to hold the flexible tube 46 in place on the user's finger. At the distal end to the brush, irrigation tube 44 is connected to a liquid reservoir (not shown) through conduit 47 which may be under pressure.

Figure 5:
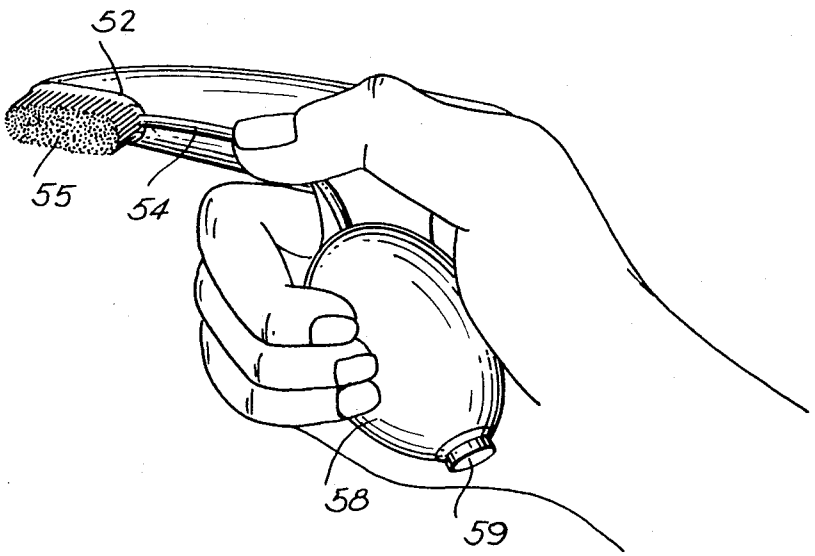
FIG. 5 shows an alternative embodiment wherein the toothbrush similar to that of FIGS. 3 and 4 is equipped instead with a pump-bearing, flexible reservoir for dispensing a fluid.

FIG. 5 illustrates an alternative embodiment of the brush of the present invention wherein the irrigation tube 54 is removable. Tube 54 is removably attached at one end to brush base 52. At the other end, tube 54 is connected to a flexible (squeezable) liquid reservoir 58 in the shape of an ordinary bulb reservoir-dispenser. Reservoir 58 can be held in the hand of the user and squeezed (pumped) to control liquid flow through tube 54 to the use point. Reservoir 58 is preferably equipped with an opening 59 for refilling and communicates with the air via the openings 55 of brush base 52. The liquid can be fluoride, an antiseptic and the like. Of course, the brush can be used without the dispenser by detaching the irrigation tube 54.

Figure 6:
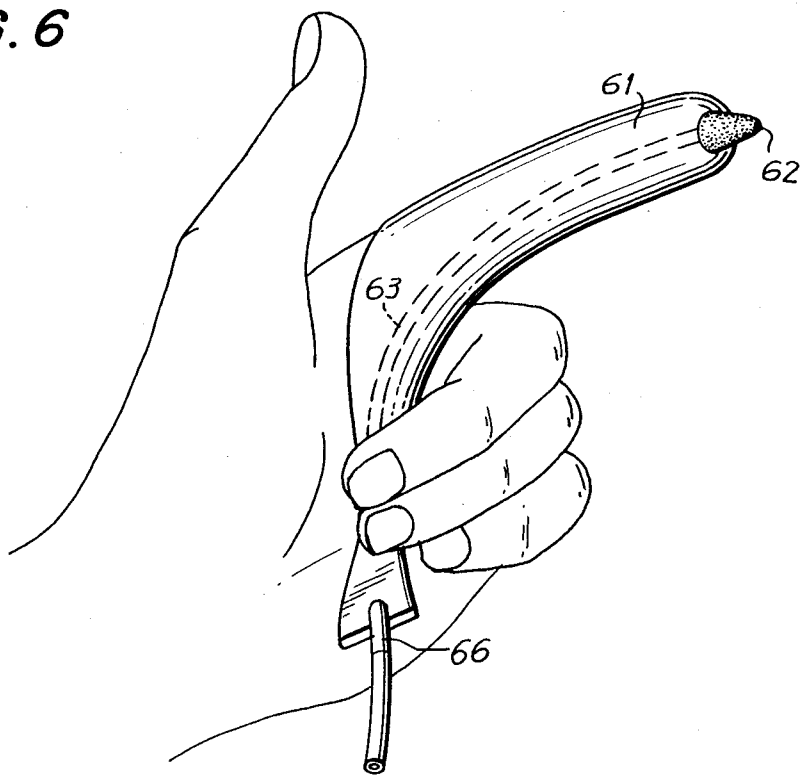
FIG. 6 shows an alternative embodiment of the present invention wherein, instead of a brush, a rubber tip is used for gum massage. The tip is connected through a valved tube to a water jet.

FIG. 6 shows an alternative embodiment of the present invention wherein a rubber tip 62 is affixed at the finger tip of "glove" finger 61. The rubber tip is used for gum massage and can be irrigated by tube 63 (shown in dotted lines) which communicates with a source of liquid under pressure, such as a water jet (not shown) via valve 66.

It will be appreciated that the brush of the present invention can also be used in all cleaning tasks where control and dexterity are important such as the cleaning of car carburetors and other hard-to-reach surfaces, where flexibility of the brush can be advantageously used.

Although preferred embodiments of the invention have been described in detail, it is contemplated that modifications of the article of the present invention may be made and that some features may be employed without others, all within the spirit and scope of the invention and the accompanying claim.

What is claimed is:

1. A finger operated article for dental care comprising:

a flexible tube having inner and outer surfaces and a closed end, said tube resembling the finger of a glove and being suitable for wear on the finger of the user;

a dental care implement mounted at the closed end of said tube at a position on the outer tube surface corresponding to the portion of the inner surface coming in contact with the user's fingertip; and a flexible irrigation tube attached to said implement for delivery of a fluid to said implement at a use point, the irrigation tube being connected to a bulb resevoir for containing said fluid, said irrigation tube being removably attached to said implement and said irrigation tube being substantially located within said flexible tube, and said bulb reservoir forming a handle for holding in the palm of the user's hand, thereby maintaining said flexible tube substantially fixed on said user's finger.

* * * * *